United States Patent [19]

Dawson

[11] Patent Number: 4,695,220

[45] Date of Patent: Sep. 22, 1987

[54] ACTUATOR FOR VARIABLE VANES

[75] Inventor: John Dawson, Boxford, Mass.

[73] Assignee: General Electric Company, Lynn, Mass.

[21] Appl. No.: 775,550

[22] Filed: Sep. 13, 1985

[51] Int. Cl.[4] ..... F04D 29/56

[52] U.S. Cl. ..... 415/9; 415/156; 415/160

[58] Field of Search ..... 415/9, 148, 146, 147, 415/156, 160, 161, 162, 163, 164

[56] References Cited

U.S. PATENT DOCUMENTS

| | | | |
|---|---|---|---|
| 3,060,706 | 10/1962 | Hess | 64/28 |
| 3,639,072 | 2/1972 | Munkstrand | 415/9 |
| 4,022,540 | 5/1977 | Young | 415/9 |
| 4,040,766 | 8/1977 | Sekido et al. | 415/9 |
| 4,050,844 | 9/1977 | Miller et al. | 415/147 |
| 4,514,141 | 4/1985 | Marey | 415/160 |

*Primary Examiner*—Robert E. Garrett

*Assistant Examiner*—Joseph M. Pitko

*Attorney, Agent, or Firm*—Francis L. Conte; Derek P. Lawrence

[57] ABSTRACT

Disclosed is an actuator for rotating a plurality of circumferentially spaced variable vanes each having a spindle extending through a casing about which the vane is rotatable. The actuator includes an arcuate unison member and a plurality of levers each having first and second ends, respective ones of the levers being fixedly attached to a vane spindle at the lever first end and rotatably attached to the unison member at the lever second end. Frangible means are provided for allowing at least one of the vanes to be rotated to an angular position different from the position of adjacent ones of the vanes upon impact of the one vane by a foreign object, and limit means are provided for maintaining the angular position of the one vane within predetermined limits with respect to the angular position of adjacent vanes to prevent 1/REV excitation.

8 Claims, 5 Drawing Figures

ACTUATOR FOR VARIABLE VANES

The Government has rights in this invention pursuant to Contract No. F33657-80-C-0999 awarded by the Department of the Air Force.

BACKGROUND OF THE INVENTION

The present invention relates generally to actuation systems for concurrently rotating a plurality of circumferentially spaced variable vanes, and, more specifically, to an actuator including means to maintain the angular position of the vanes within predetermined limits upon damage to the actuator caused by foreign objects.

Gas turbine engines are typically designed for accomodating the ingestion of foreign objects such as birds without a total failure of the engine. The engine may include an air intake having conventionally known variable inlet guide vanes (IGVs) which are rotatable over a predetermined angular position range.

One conventional manner of accommodating foreign object damage is to increase the strength of the IGVs by, for example, increasing the relative dimensions thereof. This arrangement may be undesirable because it adds additional weight and the increased size of the IGVs may adversely affect aerodynamic performance.

Furthermore, in the event an IGV is substantially damaged due to the impact of foreign objects and is thereby allowed to rotate independently of adjacent IGVs, a 1/REV excitation will be generated which can lead to high cycle fatigue damage of rotating blades in the engine.

SUMMARY OF THE INVENTION

Accordingly, one object of the present invention is to provide a new and improved actuator for variable vanes.

Another object of the present invention is to provide a new and improved actuator for variable vanes including means for accommodating foreign object damage and maintaining the angular position of the damaged vanes within a predetermined range to prevent 1/REV excitation.

Another object of the present invention is to provide a new and improved actuator for variable inlet guide vanes having relatively simple and light weight elements cooperating to accomodate foreign object damage while maintaining any damaged IGV within a predetermined range of angular positions.

The invention includes an actuator for rotating a plurality of circumferentially spaced variable vanes each having a spindle extending through a casing about which the vane is rotatable. The actuator includes an arcuate unison member and a plurality of levers each having first and second ends, respective ones of the levers being fixedly attached to a vane spindle at the lever first end and rotatably attached to the unison member at the lever second end. Frangible means are provided for allowing at least one of the vanes to be rotated to an angular position different from the position of adjacent ones of the vanes upon impact of the one vane by a foreign object, and limit means are provided for maintaining the angular position of the one vane within predetermined limits with respect to the angular position of adjacent vanes to prevent 1/REV excitation.

In accordance with an exemplary, preferred embodiment of the invention the frangible means includes a shear pin which is breakable upon impact of foreign objects against the vane, and the limit means includes a plurality of pockets in said unison member in which respective ones of the lever second ends are positioned, the pocket including a first wall for preventing the uncontrolled travel of the lever second end upon breakage of the shear pin.

BRIEF DESCRIPTION OF THE DRAWING

The novel features believed characteristic of the invention are set forth in the claims. The invention, in accordance with preferred embodiments, together with further objects and advantages thereof, is more particularly described in the following detailed description taken in conjunction with the accompanying drawing in which:

DETAILED DESCRIPTION

Figure 1:
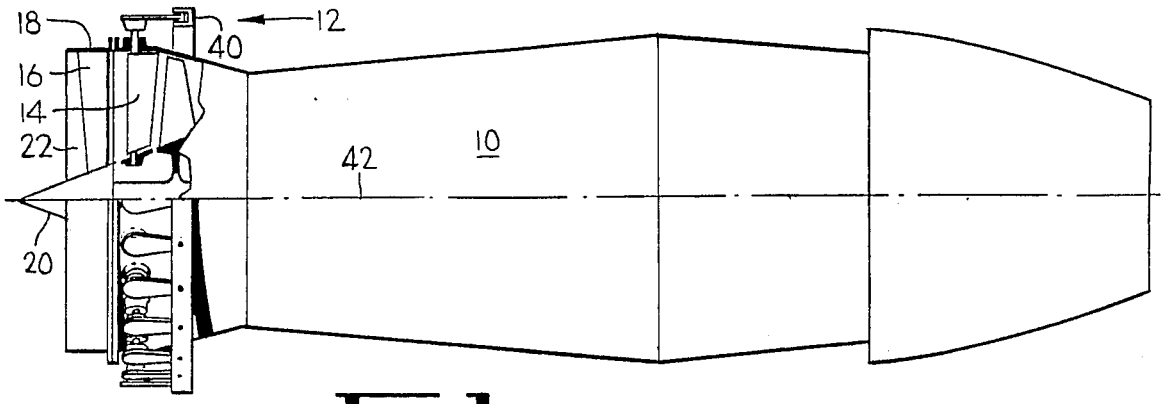
FIG. 1 is a partly sectional and schematic view of a gas turbine engine including an actuator for a variable IGVs in accordance with a preferred embodiment of the invention.

Illustrated in FIG. 1 is a gas turbine engine 10, which is conventional except for an actuator, indicated generally at 12, in accordance with an exemplary, preferred embodiment of the present invention. The actuator 12 is effective for simultaneously rotating a plurality of circumferentially-spaced variable vanes, which may, for example, be inlet guide vanes (IGVs) 14 as illustrated. In the exemplary engine 10 illustrated, the IGVs 14 are located immediately downstream of a plurality of conventional, circumferentially-spaced front frame struts 16. The struts 16 extend between an outer casing 18 and a conical inner hub 20, the casing 18 and the hub 20 defining therebetween an annular inlet duct 22 of the engine 10.

Air enters the engine 10 through the inlet duct 22 and is suitably channeled by conventional structures to a conventional fan, compressor, combustor, and turbine, not shown. The present invention relates specifically to the actuator 12 for variable vanes such as the IGVs 14 and therefore further description of the engine 10 is not required.

Figure 2:
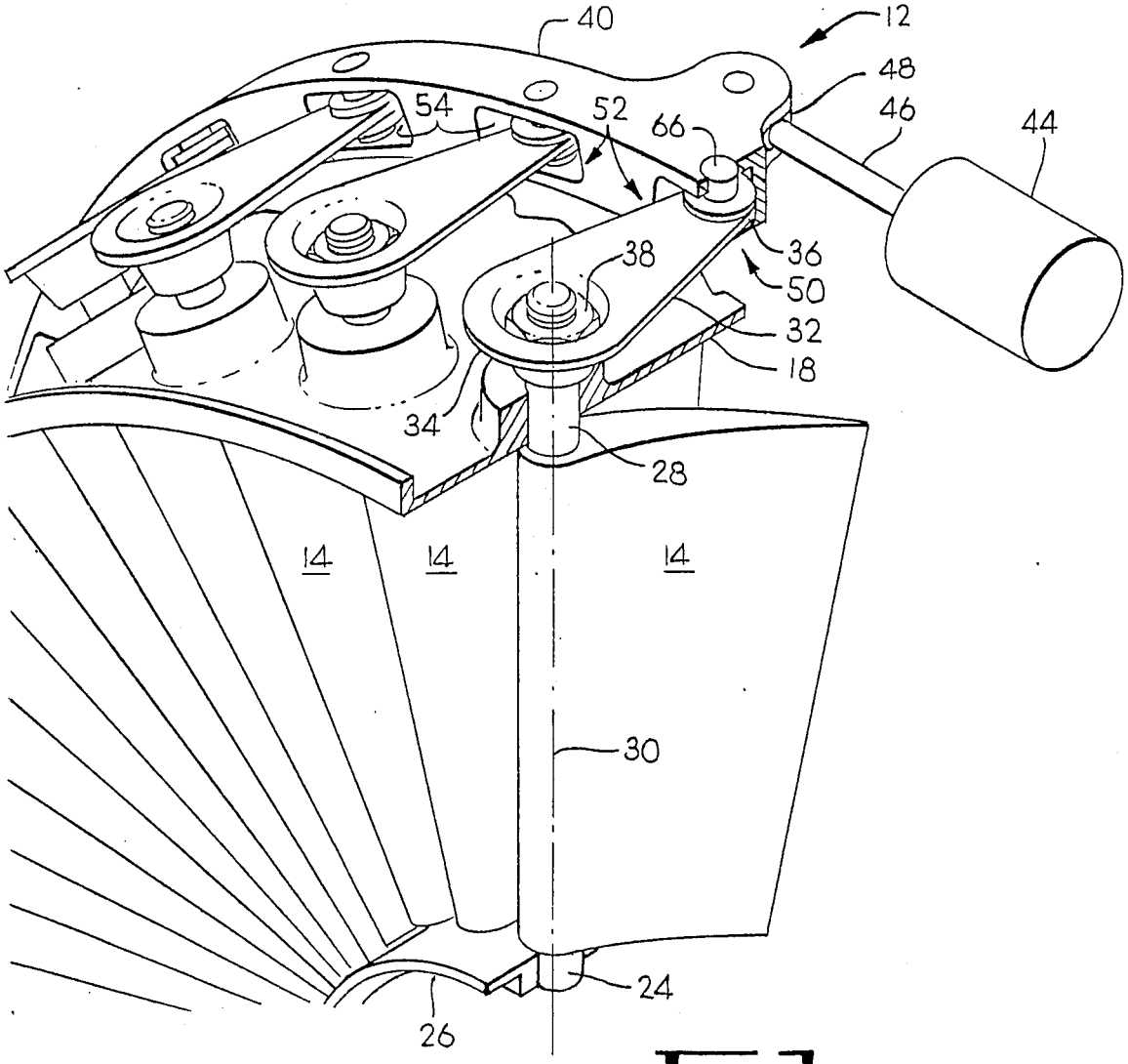
FIG. 2 is an enlarged, sectional, three-dimensional view of the actuator illustrated in FIG. 1.

Illustrated in FIG. 2 is an enlarged sectional view of the actuator 12 and the IGVs 14 illustrated in FIG. 1. Each of the IGVs 14 includes a radially inner spindle 24 conventionally mounted to an inner shroud 26 to allow the IGV 14 to rotate. The IGV 14 further includes a radially-outer spindle 28 extending through the casing 18 and conventionally mounted thereto for allowing the IGV 14 to rotate. More specifically, each IGV 14 is conventionally mounted to allow rotation about a generally radial axis 30 extending through the inner spindle 24 and the outer spindle 28.

The actuator 12 in accordance with the exemplary embodiment illustrated includes a plurality of circumferentially spaced levers 32, each having a first end 34 and an opposite, second end 36. The first end 34 of each lever 32 is fixedly attached to the vane outer spindle 28, for example, by a nut 38 which threadingly engages the outer spindle 28. The actuator 12 further includes an arcuate unison member 40 which, in the embodiment illustrated, is annular and disposed coaxially with respect to the IGVs 14 about a longitudinal centerline 42 of the engine 10 (see FIG. 1). The actuator 12 also includes means for rotatably joining the second ends 36 of the levers 32 to the unison member 40 (which, in the embodiment illustrated in FIG. 3, may be a shear pin 66), which is effective to cause the levers 32 and the vanes 14 to rotate about the radial axis 30 as the unison member is rotated in a circumferential direction.

The unison member 40 may be rotated by conventional means including for example a hydraulic driver 44 having an output shaft 46 suitably attached to the unison member 40 by a spherical bearing 48, for example. The driver 44 is effective for extending and retracting the output shaft 46 to cause the unison member 40 to rotate in opposite directions to cause the IGVs 14 to rotate in opposite directions, respectively, for controlling angular positions thereof.

A significant feature of the actuator 12 is frangible means indicated generally at 50, which is associated with each lever 32 and which is effective for allowing each IGV 14 to be rotated to an angular position different from the position of adjacent ones of the IGVs 14 upon impact of such IGV 14 by a foreign object (such IGV 14 being hereinafter referred to as a first IGV 14).

Inasmuch as the uncontrolled positioning of the first IGV 14 damaged by a foreign object might cause a 1/REV excitation, limits means indicated generally at 52 are also provided for maintaining the angular position of the first IGV 14 within predetermined limits with respect to the angular position of adjacent IGVs 14.

Figure 3:
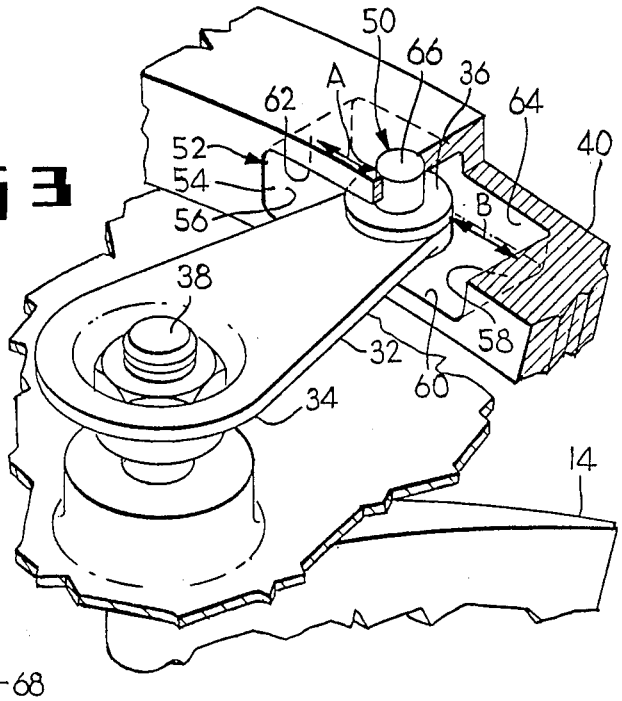
FIG. 3 is an enlarged view of a portion of the actuator illustrated in FIG. 2.

More specifically, and referring to the exemplary, preferred embodiment of the invention illustrated in FIGS. 2 and 3, the limit means 52 preferably comprises a plurality of pockets 54 associated with respective ones of the levers 32, each defined by first and second circumferentially-spaced and substantially flat walls 56 and 58, respectively, and third and fourth radially-spaced walls 60 and 62, respectively, disposed substantially perpendicularly to the first and second walls 56 and 58. A fifth, bottom wall 64 joins the first, second, third and fourth walls 56, 58, 60 and 62 to define the pocket 54 which faces outwardly toward and receives the lever second end 36.

The frangible means 50 in the preferred embodiment illustrated comprises a shear pin 66 which extends through the lever second end 36 through both the third and fourth walls 60, 62 of the unison member 40. The shear pin 66 may be fixedly connected to the lever second end 36 and rotatably connected in complementary holes in the third and fourth walls 60/62 or vice versa. The shear pin 66 may also be rotatably connected to the lever second end 36 and the third and fourth walls 60/62. Suitable bearings, for example, bushings, may also be provided between the shear pin 66 and the lever second end 36 and/or between ths shear pin 66 and the third and fourth walls 60/62 for allowing the lever 32 to rotate without restriction with respect to the unison member 40.

During operation, if a foreign object impacts a first IGV 14 with a predetermined force, the shear pin 66 is designed to break for absorbing the impact of the foreign object to reduce the overall damage to the IGVs 14 and the actuator 12. Of course, the amount of this predetermined force is to be determined for each particular design and is selected so that the shear pin 66 will not break if the impact force is relatively low and therefore would not substantially damage the IGVs 14 and the actuator 12.

Once the shear pin 66 is severed the lever 32 is free to rotate within the limits imposed by the pocket 54. The first and second walls 56 and 58 are predeterminedly spaced in the circumferential direction from respective sides of the lever second end 36 distances A and B, respectively, to limit and control the travel of the lever 32 and the IGV 14. The distances A and B may be equal to unequal, depending on particular design requirements, including the dimensions of the pocket 54, for maintaining the lever second end 36 therein throughout the selected angular position range of the IGVs 14 and to limit the angular deviation of a first IGV 14 within this range to prevent 1/REV excitation.

For example only, unequal distances A and B were predeterminedly selected in an actuator 12 built for allowing a first IGV 14 to rotate preferably no more than plus or minus six degrees. The first and second walls 56 and 58 act as stops to the travel of the lever 32 and IGVs 14 and maintain the angular position of the IGV 14 within the selected plus or minus degree values with respect to the angular positions of adjacent vanes. Of course, the actual values of the plus/minus degree values may be less than or greater than six degrees, depending upon the particular design requirements.

Accordingly, the actuator 12 provides structure which is effective for absorbing the impact energy of a foreign object impacting against one or more IGVs 14 by the shearing of the shear pin 66. The actuator 12 then allows the first IGV 14 associated with a severed shear pin 66 to be rotated to an angular position different from the position of undamaged adjacent ones of the IGVs 14. Such angular position will be maintained by the pocket 54 within predetermined limits chosen to provide a relatively small difference in the position of the damaged first IGVs 14 with respect to that of undamaged IGVs 14, thusly preventing 1/REV excitation.

Once the shear pin 66 is severed, the conventionally known airflow loads acting over the first IGV 14 will cause the first IGV 14 to rotate to either the first wall 56 or the second wall 58 and be held in position thereagainst during most engine operating conditions. It is also possible that under certain conditions the first IGV 14 may be held in an intermediate position by such airflow loads.

Figure 4:
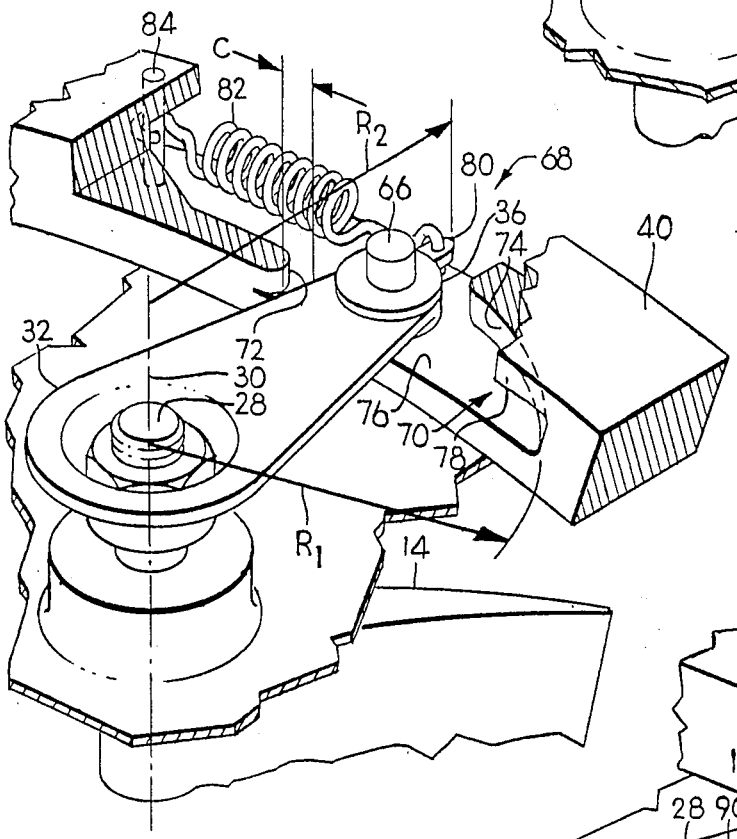
FIG. 4 is a three-dimensional, partly sectional view of a portion of an actuator for variable vanes in accordance with a second embodiment of the invention.

Illustrated in FIG. 4 is a second embodiment of the invention, which is generally similar to the embodiment illustrated in FIGS. 2 and 3. However, a different limit means 68 is provided for maintaining the angular position of a damaged IGV 14 within predetermined limits. More specifically, the limit means 68 includes a pocket 70 disposed in the unison member 40 for receiving the lever second end 36.

The pocket 70 is defined by first and second circumferentially-spaced and opposing lateral walls 72 and 74, respectively, and third and fourth radially inner and outer walls 76 and 78, respectively, disposed perpendicularly to the first and second walls 72 and 74. The first wall 72 is predeterminedly spaced a distance C from the lever second end 36. The second wall 74 is generally concave with a radius $R_1$ measured with respect to the radial axis 30 extending through the outer spindle 28. The radius $R_1$ is larger than the radius $R_2$ of a distal end 80 of the lever 32 to allow the lever 32 to rotate without obstruction over the second wall 74 upon shearing of the shear pin 66.

The limit means 68 further includes a spring 82 suitably connected to the lever second end 36 and to the unison member 40 to bias the lever 36 toward the first wall 72. For example only, the spring 82 may be located on the first wall 72 side of the lever 36 and connected at one end to the unision member 40 over a retaining pin 84 fixedly attached to the unision member 40 and connected at a second end to an aperture at the lever distal end 80. The spring 82 is provided with a predetermined tension so that when the shear pin 66 is severed due to the impact of a foreign object against the IGV 14 a force generated by the spring 82 is predeterminedly selected to overcompensate for aerodynamic forces acting over the IGV 14 which would tend to rotate the lever 32 against the force being generated by the spring 82. In this way the IGV 14 is maintained against the first wall 72.

The first wall 72 acts as one stop to prevent in one direction undesirably large angular rotation of the IGV 14 due to foreign object damage. In the other direction, the spring 82 increases its retraction force as the lever 32 is caused to rotate away from the pin 84. Therefore, during initial impact of the foreign object, the lever 32 may be caused to rotate over the second wall 74 but will be returned to rest against the first wall 72 due to the action of the spring 82.

Figure 5:
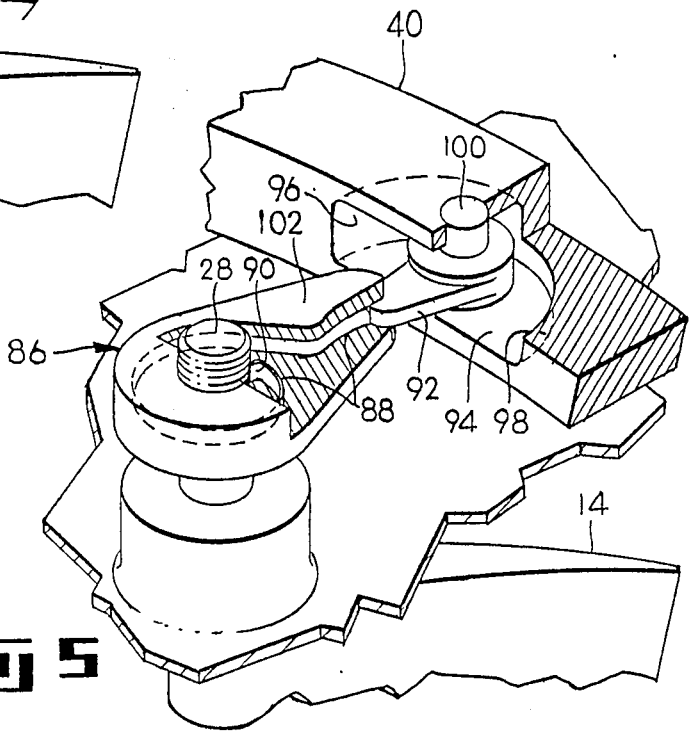
FIG. 5 is a three-dimensional, partly sectional view of a portion of an actuator for variable vanes in accordance with a third embodiment of the invention.

Illustrated in FIG. 5 is a third embodiment of the actuator 12 according to the present invention. In this embodiment, a lever 86 joins the lever outer spindle 28 to the unison member 40 in the same manner as illustrated in FIGS. 2 and 3. However, the lever 86, itself, in this embodiment of the invention includes both frangible means and limit means to absorb the energy due to foreign object damage and to limit the travel of the IGV 14.

More specifically, the limit means comprises a helically wound planar coil spring 88 having a first end 90 fixedly attached to the spindle second end 28, and an opposite, enlarged second end 92 suitably rotatably mounted to the unison member 40. In particular, the unison member 40 includes a pocket 94 defined by laterally opposing first and second walls 96 and 98, respectively. Means 100 for rotatably joining the lever second end 92 to the unison member 40 may include, for example, a conventional spherical bearing assembly, or a simple pin as shown.

The coil spring 88 of the lever 86 is conventionally encapsulated, by casting or molding for example, with a suitable material 102 such as, for example, carbon or an alumina or glass ceramic, which results in a relatively rigid lever 86, which is effective for transmitting forces from the unision member 40 to the IGV 14 to cause rotation during conventional operation. Upon impact of a foreign object against an IGV 14, the material 102 is caused to be shatterd by forces transmitted thereto thusly absorbing some of the impact energy and allowing the coil spring 88 to elastically deflect and also absorb a portion of the impact energy. The coil spring 88 is suitably sized to return the IGV 14 to an angular positon generally identical to the angular position of adjacent IGVs 14 after the initial impact of the foreign object. The angular positon of the first IGV 14 is also maintained at such angular position by the restoring force of the helical spring 88. The helical spring 88 provides a varying limit to the amount of angular deviation of the IGV 14 which is directly proportional to the stiffness rate of the spring 88 and the amount of force transmitted by a foreign object. More force will cause the IGV 14 to deviate more during impact. However, the IGV 14 will be returned to its original position after such impact.

While there have been described herein what are considered to be preferred embodiments of the present invention, other modifications of the invention shall be apparent to those skilled in the art from the teachings herein, and it is, therefore, desired to secure in the appended claims all such modifications as fall within the true spirit and scope of the invention.

More specifically, and for example, although the invention has been described with respect to inlet guide vanes (IGVs 14), the invention my be practiced with any variable vanes which utilize an actuator for concurrently rotating a plurality of circumferentially-spaced vanes. Although radially inner and outer spindles are disclosed for each IGV 14, a single radially outer spindle, such as is used in variable compressor stator vanes, may also be utilized.

Furthermore, the pocket 54 may be filled with a suitable elastomeric material which would provide for additional impact energy absorption while at the same time returning the lever 32 to its original position.

Accordingly, what is desirable to be secured by Letters Patent of the United States is the invention as recited in the following claims.

I claim:

1. An actuator for rotating a plurality of variable vanes spaced circumferentially about a centerline, each having a spindle extending through a casing about which the vane is rotatable, comprising:

a plurality of levers, each having first and second ends, respective ones of said levers being fixedly attached to said vane spindle at said lever first end;

an arcuate unison member disposed coaxially about said centerline;

means for rotatably joining said lever second ends to said unison member to cause said levers and said vanes to rotate as said unison member is rotated;

frangible means for allowing a first one of said vanes to be rotated to an angular position different from the angular position of adjacent ones of said vanes upon impact of said first vane by a foreign object; and limit means operatively associated with said unison member for allowing said first vane to rotate with rotation of said unison member after breakage of said frangible means for maintaining the angular position of said first vane within predetermined limits with respect to the angular position of said adjacent vanes.

2. An actuator for variable vanes according to claim 1 wherein said frangible means comprises a shear pin in said joining means breakable to allow said joining means to disconnect said lever from said unison member, and wherein said limit means comprises first and second opposing walls in said unison member defining a pocket, said first and second walls being predeterminedly circumferentially spaced from said lever second end, at least one of said pocket walls providing a stop to limit the circumferential travel of said lever second end upon disconnection of said joining means.

3. An actuator for variable vanes according to claim 2 wherein said first and second pocket walls are unequally spaced from said lever and both walls provide stops to limit said circumferential travel.

4. An actuator for variable vanes according to claim 3 wherein said first and second pocket walls are substantially flat.

5. An actuator for variable vanes according to claim 2 wherein said first pocket wall is spaced from said lever second end and is effective as said stop, and said second wall has a concave surface with a radius measured from the center of said vane spindle which is larger than the radius of a distal end of said lever to allow said lever second end to rotate without obstruction over said second wall after said shear pin is broken, and wherein said limit means further includes a spring connected between said lever second end and said unison member to apply a force to prevent said lever from being rotated out of said pocket and to return said lever against said first wall.

6. An actuator for variable vanes according to claim 1 wherein said lever comprises both said frangible means and said limit means and includes a helically wound planar coil spring fixedly connected to said vane spindle at said lever first end and rotatably connected to said unison member at said lever second end, said coil spring being encased in a solid material so that said lever is rigid until impact of said first vane by the foreign object causing said material to fracture and separate from said spring, and is elastic after said impact.

7. An actuator for rotating a plurality of variable vanes circumferentially spaced about a centerline, each having a spindle extending through a casing about which the vane is rotatable, comprising:

a plurality of levers, each having first and second ends, respective ones of said levers being fixedly attached to said vane spindle at said lever first end;

an arcuate unison member disposed coaxially about said centerline and including a plurality of circumferentially spaced pockets, each of said pockets being defined by first and second opposing walls joined by a base wall in said unison member;

means for rotatably joining said lever second ends to said unison member in said pockets to cause said levers and vanes to rotate as said unison member is rotated, said joining means including a shear pin extending between said lever second end and said unison member breakable to allow said lever and unison member to separate for allowing a first one of said vanes to be rotated to an angular position different from the angular position of adjacent ones of said vanes upon impact of said first vane by a foreign object; and said pocket first and second walls being predeterminedly spaced from said lever in a circumferential direction to provide predetermined limits to the circumferential travel of said lever second end in said pocket upon breakage of said shear pin for maintaining the angular positon of said first vane within predetermined limits with respect to the angular position of said adjacent vanes.

8. An actuator for variable vanes according to claim 7 wherein said vanes comprise inlet guide vanes having outer and inner spindles about which said vanes rotate, said outer spindles being connected to said levers and wherein said unison member is annular.

* * * * *